US005788875A

United States Patent [19]

Walser

[11] Patent Number: 5,788,875

[45] Date of Patent: Aug. 4, 1998

[54] DEVICE FOR A DETACHABLE SECURING OF FORMWORK BOARDS

[76] Inventor: Hans-Peter Walser, Rutibach 7, CH-8340 Hinwil, Switzerland

[21] Appl. No.: 808,151

[22] Filed: Feb. 28, 1997

Related U.S. Application Data

[63] Continuation-in-part of Ser. No. 427,224, Apr. 24, 1995, abandoned, which is a continuation of Ser. No. 150,125, filed as PCT/CH93/00066, Mar. 11, 1993, abandoned.

[30] Foreign Application Priority Data

Mar. 30, 1992 [CH] Switzerland ..... 1026/92

[51] Int. Cl.[6] ..... E04G 17/14

[52] U.S. Cl. ..... 249/210; 249/207; 249/219.1

[58] Field of Search ..... 249/207, 210, 249/219.1, 219.2

[56] References Cited

U.S. PATENT DOCUMENTS

| | | | |
|---|---|---|---|
| 2,741,821 | 4/1956 | Findley | 249/219.1 |
| 3,778,020 | 12/1973 | Burrows et al. | 249/219.1 |
| 4,290,985 | 9/1981 | Barale | 249/219.2 |
| 5,076,536 | 12/1991 | Fitzgerald | 249/219.1 |
| 5,196,210 | 3/1993 | Yoshihara et al. | 249/95 |

FOREIGN PATENT DOCUMENTS

| | | |
|---|---|---|
| 352658 | 10/1991 | European Pat. Off. . |
| 8127001 | 2/1982 | German Dem. Rep. . |
| 3512768 | 12/1985 | German Dem. Rep. . |
| 624446 | 7/1981 | Switzerland . |
| 625589 | 9/1981 | Switzerland . |
| 678081 | 7/1991 | Switzerland . |

*Primary Examiner*—James P. Mackey
*Attorney, Agent, or Firm*—Breiner & Breiner

[57] ABSTRACT

Proposed for detachably securing formwork panels, formwork boards, insulation and facade panels, breastwork bars, scaffolding brackets, etc., is a holding device designed to be embedded and fixed in place in a concrete structure of a building. This holding device has one or more sockets, at least one socket having threaded or otherwise contoured walls, in which matching parts of the securing, supporting and/or clamping elements mentioned can be detachably inserted. This holding device is a substantially L-shaped anchorable support member made of a polymeric material, having one or more sockets in which matching parts of the securing, supporting and/or clamping elements mentioned can be detachably inserted.

23 Claims, 4 Drawing Sheets

39
31
36
35
33
37
19
16
5
7
21
1
17
17a
13
13
13
11
3
9

19
27
25
5
1
23
17
3

16
19
18a
18b
5
13
9
1
18c
16
3
17
17a
7

31
39
35
19
36
23
16
5
33
18c
17a
38
3
9
17
7
7a 43
41
40
39
33
31
19
5
16
1
17
3
63
53
65
69
51a
51
61
67

DEVICE FOR A DETACHABLE SECURING OF FORMWORK BOARDS

This application is a continuation-in-part of application Ser. No. 08/427,224 filed on Apr. 24, 1995, now abandoned, which was a continuation of application Ser. No. 08/150,125, filed as PCT/CH93/00066, Mar. 11, 1993, now abandoned.

FIELD OF THE INVENTION

The present invention relates to a device specifically for detachably securing formwork boards, facade and insulation panels, breastbars, scaffolding brackets and the like, including an anchorable holding part for receiving at least one securing, support and/or clamping element, a front end formwork with a device, a-scaffolding breastbar and/or formwork structure with a device and an arrangement for securing insulation and/or facade panels with a device.

BACKGROUND OF THE INVENTION

In formwork encasing of lateral terminations of building structural parts, specifically of concrete floor slabs and the like, the formwork board which in general must be mounted vertically is secured by means of a threaded bolt connection onto the holding part which is to be embedded in concrete, such as described, e.g., in DE-GM-81 27 001. This method is quite time consuming and the insertion of the screw thread into the thread of the nut is quite tedious because it is not directly visible.

CH-PS-624 446 describes a similar construction, where a support and/or securing element for a front end formwork is described which, for instance, can be designed as an angle or L-shaped, respectively. A drawback of this design is that metal parts projecting out of the concrete or the wall, respectively, must be removed and the wall itself reworked.

In CH-PS-625 589, a L-shaped angle iron with securing means for mounting a periphery formwork is described whereby the angle iron is held at a distance from the floor slab formwork and the periphery formwork by distance pieces present at both legs in such a manner that it is completely embedded in concrete. The proposed securing means includes a winged screw which must be screwed into a mother thread which, such as mentioned above, is quite disadvantageous at building sites.

A further drawback of all mentioned solutions is that relatively expensive angle iron pieces are simply embedded in concrete without being in a position to serve any other purposes.

In DE-35 12 768, finally, a formwork board securing device is described in which the formwork or the individual boards, respectively, are secured by means of a pressing-on key. The pressing-on key is held by completely pluggable, again removable securing means in an angle ironpiece whereby the latter is also embedded in the concrete mass. The advantage of this device is that the securing means and the clamping wedge are completely removable and, therefore, no reworking whatsoever is needed. However, again a relatively expensive metal part is lost due to an embedding in concrete. This solution could incorporate the possibility of locating the metal part flush with the floor slab wall or side wall, respectively, in order to possibly use it for further applications. However, as generally known, planar metal end terminations are undesirable because of an inferior adherence for placing plasters and other covering layers.

OBJECTS AND BRIEF DESCRIPTION OF THE INVENTION

It is, therefore, an object of the present invention to propose a securing device by means of which a fast setting and removing of formworks of lateral terminations at parts of structures is possible, which is cheap and is suitable for serving further uses or applications, respectively, purposes at the time of building or during the duration of the building.

In accordance with the invention, this object is solved by a device in accordance with the claims.

Proposed among others is a securing device, specifically for releasably securing formwork panels, formwork boards, insulation and facade panels, breastbars, scaffolding brackets and the like, comprising an anchorable holding part for receiving at least one securing, support and/or clamping element, which is produced at least in part of a polymeric stock or polymeric material, respectively.

Specific polymeric materials suitable for use are known mass plastic materials such as, for instance, polyethylene, PVC, ABS, polypropylene and the like, whereby obviously the selected plastic material must suit the demands made for the securing part. Preferred is a reinforced polymeric material, such as a glass fiber or glass pearls filled polymeric or plastic material.

Fiber-reinforced concrete materials, such as specifically glass fiber reinforced polymeric concrete materials, have proven to be suitable for the production of the inventive securing device. As an example shall be mentioned glass fiber or polyester fiber reinforced polymeric concrete, whereby for instance polyester or epoxy resin additives are mixed with known mineral binding agents.

The major advantage of using a polymeric material, such as for instance a glass fiber reinforced mass plastic material or polymeric concrete, in comparison with metal is that it is substantially cheaper, is easier to handle, guarantees a simple and low cost production of the securing device and additionally allows the supporting device to be mounted flush to a floor slab or side formwork because plasters or covering layers feature better adherence on plastic substrates than on metal end coverings.

Further proposed is a supporting device which comprises one or several receiving portions for a pluggable, snappable and/or screwable mounting of securing, support and/or clamping elements, specifically for releasably securing formwork panels, formwork boards, breastbars, scaffolding brackets and the like.

Further, preferred variants of the embodiments of the inventive securing device are characterized in the dependent claims.

The securing device claimed in accordance with the invention is suitable for a terminal face end formwork, such as specifically described and claimed in DE-PS-35 12 768. A detailed description of the securing device for a clamped securing of formwork panels or formwork boards for installing forms of lateral end closures of building parts such as described in DE-PS-35 12 768 is not made herein since such is known in the art and illustrated in FIG. 1 hereto.

The securing device proposed in accordance with the invention is, furthermore, suitable for a scaffolding breastbar and/or formwork construction. In this context, reference is specifically made to CH-PS-678 081 in which scaffolding and breastwork constructions on building structures and also their anchorings in or at the wall structure is extensively described. In this connection reference is made to FIGS. 6, 7, 9, 10 and 11 of CH-PS-678 081.

Finally, the securing device suggested in accordance with the invention is also suitable for securing insulation or facade panels. Correspondingly proposed is an arrangement for securing insulation and/or facade panels, including at least one inventively defined device, whereby one or several receiving members are foreseen at the device into which corresponding portions of the insulation and/or facade panels can be inserted in order to mount the same to the device.

DESCRIPTION OF THE DRAWINGS

Hereinafter, now, the invention will be explained by example more in detail with reference to the appended figures, whereby.

DESCRIPTION OF PRESENTLY PREFERRED EMBODIMENTS

Figure 1:
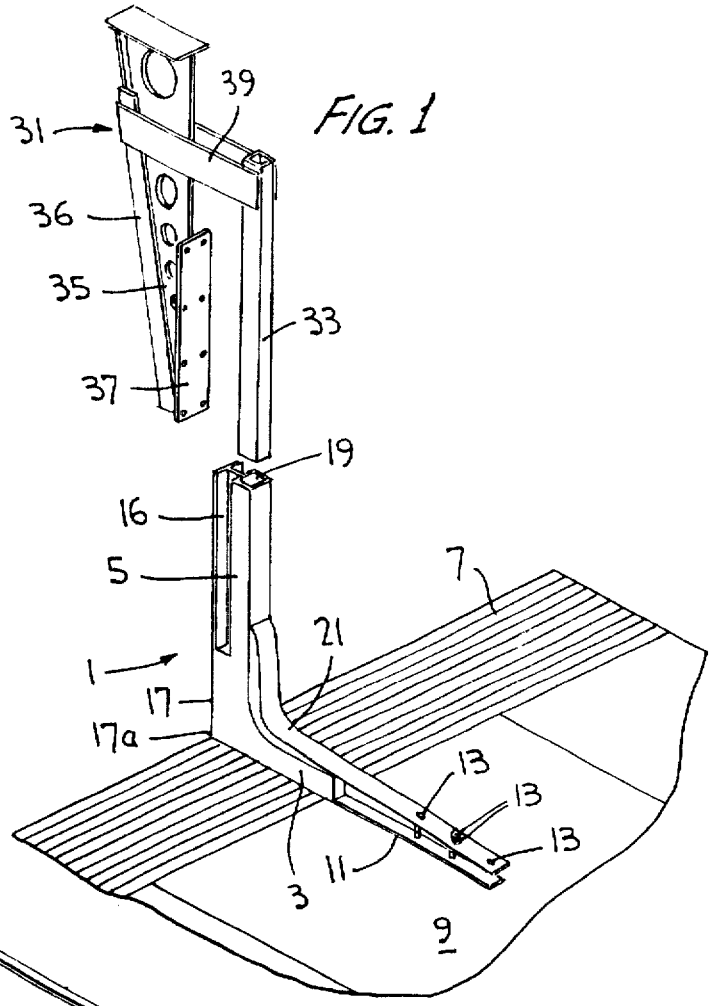
FIG. 1 illustrates perspectively an inventive plastic securing part with securing means for formwork boards according to DE-35 12 768.

In FIG. 1, an inventive securing device is illustrated perspectively, including a supporting part 1 foreseen to be embedded in concrete, which is produced preferably at least to a large extent of a polymeric material, such as for instance a glass fiber reinforced mass plastic material such as polyethylene, PVC or ABS. Other polymeric materials or plastic materials are also suitable such as, for instance, polypropylene, polyamide and the like, whereby these plastic materials are hardly selected due to cost reasons.

Fiber reinforced concrete has also been proven to be suitable, such as for instance glass fiber reinforced polymeric concrete, in which unsaturated polyester resins replace the binding agents known to form the common concrete, such as cement and water, in order to obtain a substantially higher strength. Other fibers can be used in place of glass fibers, such as polyester fibers, polyamide fibers, carbon fibers and the like, and in place of unsaturated polyester resins, epoxide resins, polyurethane resins or the like are also suitable for the production of the polymeric concrete. Specifically, if increased demands are made on such supporting parts, it is possible to use these high-grade plastic materials, reinforced by mentioned high-grade fibers of polyester, polyamide, carbon, etc. If necessary, the supporting part is to be made of metal.

The supporting part 1 is L-shaped and comprises a longer leg 3, which rests preferably by means of a bearing area 11 stably on a floor slab form 9 or a crown of a wall 7. For securing the longer leg 3 on the floor slab form 9, securing means 13 are foreseen such as, for instance, screws, nails and similar articles. The other leg 5 at which the at least partly flush abutting formwork boards or formwork panels, respectively, are to be arranged, includes preferably a tube and square-shaped holding fixture 19 into which the also square-shaped plug-in part 33 of a plug-in yoke 31 can be inserted. The plug-in yoke 31 includes further a plug-in beam 39, a wedge leg 36 and a clamping wedge 35, including a clamping surface 37 for a clamping of formwork boards at the outer side of the vertical leg 5 of the supporting part. The vertical leg 5 includes further at the side longitudinally extending notchings or groove, respectively, or notch 16, the reason and function of which will be entered into more in detail with reference to FIGS. 6 and 7.

How the mounting of a formwork board by means of an inventive plug-in device, such as illustrated in FIG. 1, proceeds will be explained later with reference to FIG. 4.

Since the supporting part 1 is foreseen to be embedded in the concrete in a building structure or in a floor slab, and in order to prevent a breaking out of the supporting part after the removal of the formwork, rib projections and the like are preferably located thereon, which are backfilled or filled out, respectively, by the concrete mass. For this reason the supporting part 1 in FIG. 1 includes a rib 15 which can act simultaneously, for instance, by means of a metal covering 21 as a reinforcing rib in order to reinforce the L-shaped supporting part 1 in its apex.

In order to plug in, for instance, scaffolding brackets or holding parts for breastworks, the longer leg 3 includes also a sleeve or tube-shaped holding fixture 17*a*, whereby its opening 17 is located at the outer side of the building structure and, accordingly, is not visible in FIG. 1.

In FIG. 2, again an inventively defined supporting part 1 is illustrated which is suitable, for instance, for a plugged in receipt of a plug-in yoke which is not shown in FIG. 2. Contrary to the supporting part 1 of FIG. 1, the holding fixture 19 is arranged in the vertical leg of the supporting part at the outer side and is flush with the face side of the building structure, wherewith a formwork board directly abuts the sleeve or tube, respectively, holding fixture 19.

Figure 2:
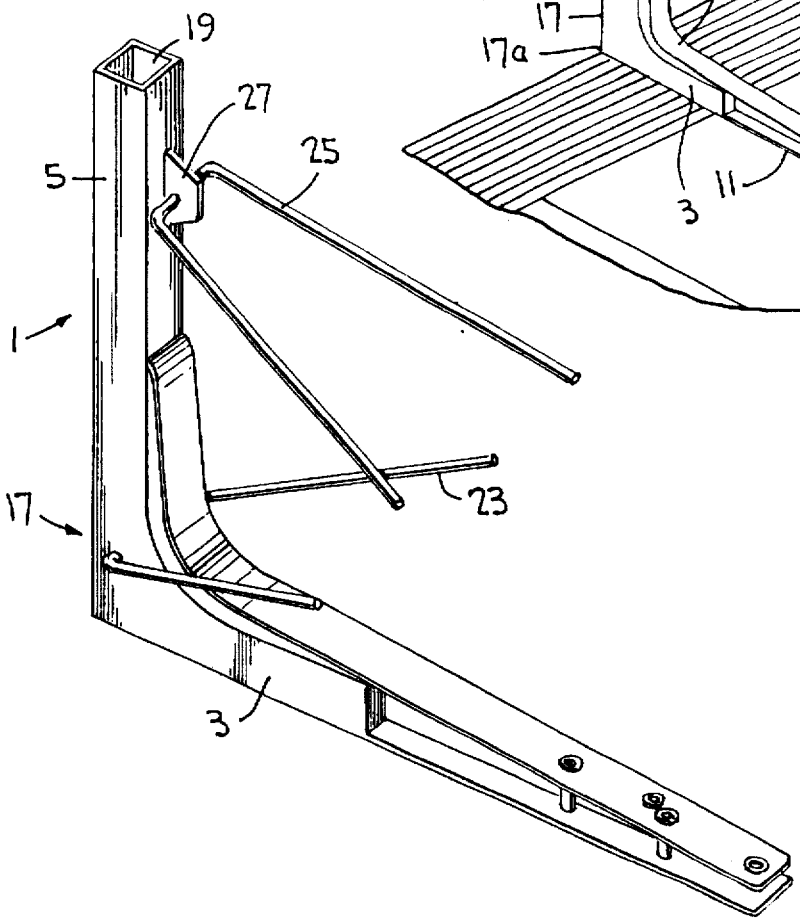
FIG. 2 illustrates a further inventive securing part with an anchoring element.

The supporting part 1, according to FIG. 2, further includes two reinforcing bars or mounting supports, respectively 23 and 25, whereby the latter are mounted in a sleeve 27 at the leg 5. These reinforcing bars or mounting supports, respectively 23 and 25, allow an additional stabilization of the supporting part 1 in the building structure which may become necessary, specifically, when plugging breastwork bars or scaffolding brackets into one of the two holding fixtures 17 or 19.

Figures 3, 4, 5:
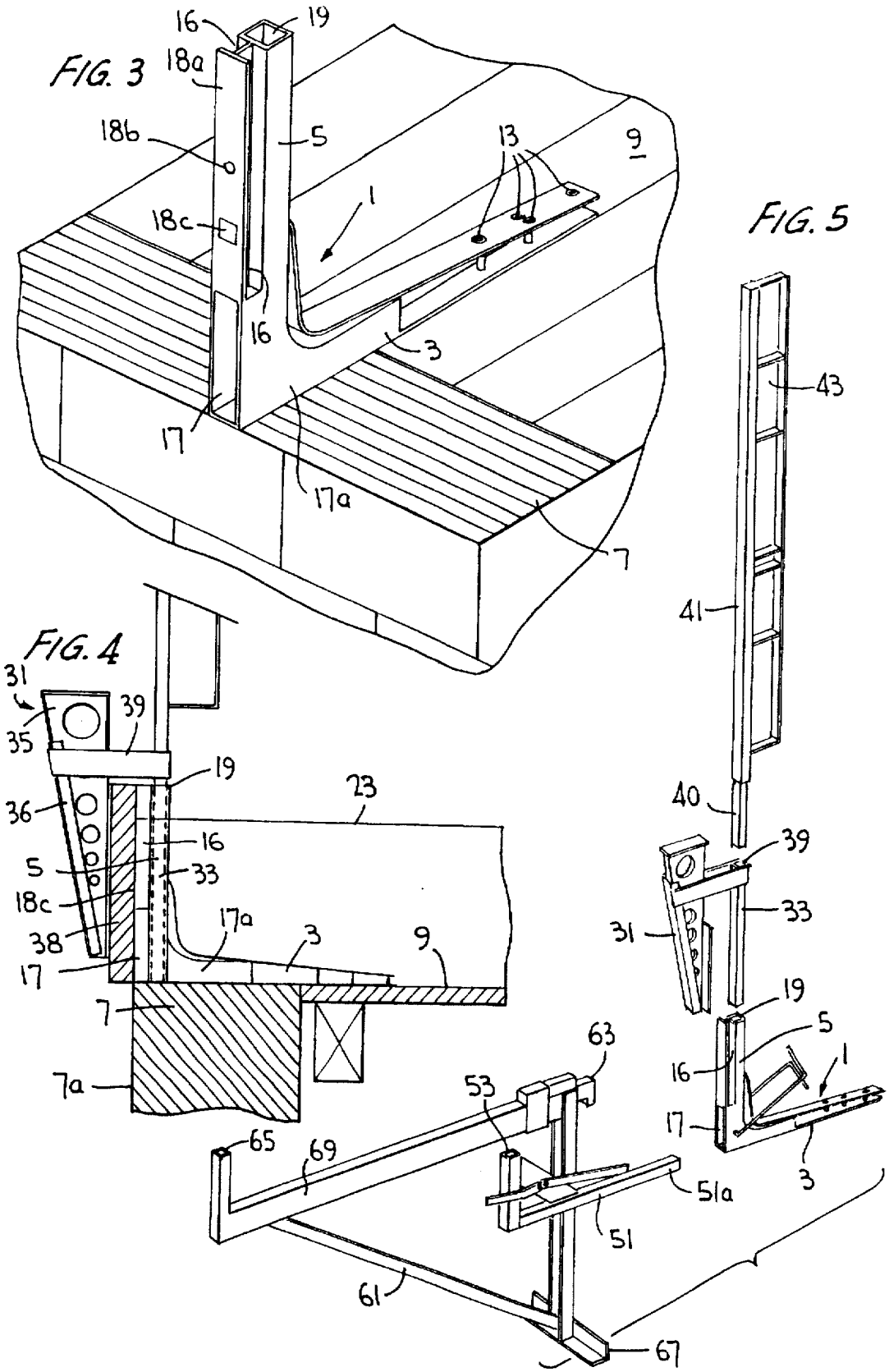
FIG. 3 illustrates the securing part of FIG. 1 perspectively from the opposite side.
FIG. 4 illustrates the securing part according to FIG. 1 in a side view at a roofing to be concreted having a lateral termination and mounted formwork in a side view.
FIG. 5 illustrates perspectively a plurality of elements for an inventively defined scaffolding breastwork and formwork structure.

In FIG. 3, a supporting part is again illustrated, perspectively from the opposite side as compared to FIGS. 1 and 2. The supporting part rests in the illustration on a crown of a wall 7 and on a floor slab formwork 9. The opening 17 of the sleeve or tube-shaped holding fixture 17*a* is now clearly visible at the front side, which fixture is set in the longer leg 3 of the supporting part 1. The supporting part 1 includes, furthermore, at the front side of the vertical leg, holding fixture openings 18*a*, 18*b* and 18*c* in which any kind of supporting elements, screws and the like can be mounted. In this way, it is for instance also possible to mount in a screw-like manner formwork boards in a conventional way to the supporting part 1. Also tool boxes, apparatuses and the like can be hooked into or mounted to the supporting part 1.

Finally, and much more importantly, is the pluggable or snappable mounting of breastwork bars or scaffolding brackets, respectively, in the two openings 17 and 19, whereby it is important that all holding fixtures and their openings are also in such a case freely accessible when the supporting part 1 is embedded in concrete in the building structure.

In FIG. 4, the arranging of the securing device according to FIG. 1 for placing a formwork and for producing a concrete floor slab is illustrated, whereby the upper surface of the floor slab to be produced is designed with broken lines and identified by the reference numeral 23. The supporting part 1 will be arranged on the floor slab form and the crown of the wall 7 of the front wall 7*a* and secured, for example, by nails. Now, the plug-in yoke 31 is inserted with the plug-in part 33 into the tube-shaped holding fixture 19 and a formwork board 38 is clamped by means of the clamping wedge 35 at the front side onto leg 5 of the supporting part 1. The concrete floor slab to be produced is thereby such that the upper surface 23 comes to lie just flush relative to the opening of the holding fixture 19, wherewith after the concrete floor slab has been completed, the plug-in yoke can easily be retrieved from the supporting part 1, wherewith the holding fixture 19 continues to be freely accessible from the outside. The same is true for the opening 17 and the holding fixtures 18*a* and 18*c*, respectively, after the formwork board 38 has been removed from the front face side of leg 5. Accordingly, it is then possible to insert into the mentioned openings or holding fixtures, respectively, any kind of parts which can be snapped in, screwed in or plugged in, as is further described below in relation to the description of FIGS. 8 and 9.

In FIG. 5, various parts of an inventive scaffolding breastwork and formwork structure are illustrated, including primarily the inventively defined supporting part 1 and also the plug-in yoke 31 illustrated in FIGS. 1 and 4.

In erecting a breastwork or a guard rail, at the outer side of a building structure, it is possible to insert a breastwork bar 41 with the corresponding plug-in part 40 either into the holding fixture 19 or a corresponding holding fixture 39 at the plug-in yoke 31, on which bar holding elements 43 are foreseen, for instance, for the placement of guard rail boards.

In an analogous manner, it is possible to plug into the holding fixture 17*a* a holding element 51 by means of its plug-in portion 51*a*, whereby a holding fixture 53 is foreseen at this holding element 51 at its front side and is directed vertically upwards for a plugged-in arranging again of a breastwork bar 41. By means of (not shown) snap-in elements at the portion 51, a slipping out of the holding fixture can be prevented.

Finally, after removing the formwork from the concrete floor slab, it is also possible to insert a scaffolding fixture 61 into the holding fixture 19 using the plug-in part 63. The scaffolding fixture 61 includes a horizontal beam 69 for the mounting of floor boards, a support 67 for a lateral supporting of the scaffolding fixture on the building structure and at the front side a holding fixture 65 as well in order to also locate a breastwork bar 41 at the scaffolding fixture.

FIG. 5 illustrates a possible variant of an inventive scaffolding breastwork and formwork design with an inventively defined supporting part which is foreseen to be concreted into a building structure. This supporting part is produced preferably of a reinforced plastic material, such as, for example, polyethylene or PVC. It can, however, also be made of metal. Obviously, the other structural parts also can be made of metal or the mentioned plastic material. Due to the high strength figures of such structural parts which can be obtained, including when made of a reinforced plastic material, it is in the case of a corresponding dimensioning of the individual parts by all means possible to produce the same from the mentioned plastic material. The major advantage of producing all of these parts from plastic material consists on the one side in the favorable production thereof and on the other side in its low weight which can be quite a major advantage during handling and transport.

With regard to the design of the scaffolding brackets and guard rails, reference is made specifically to CH-PS-678 081 in which such designs are illustrated among others in FIGS. 6, 7, 9, 10 and 11.

Figure 6:
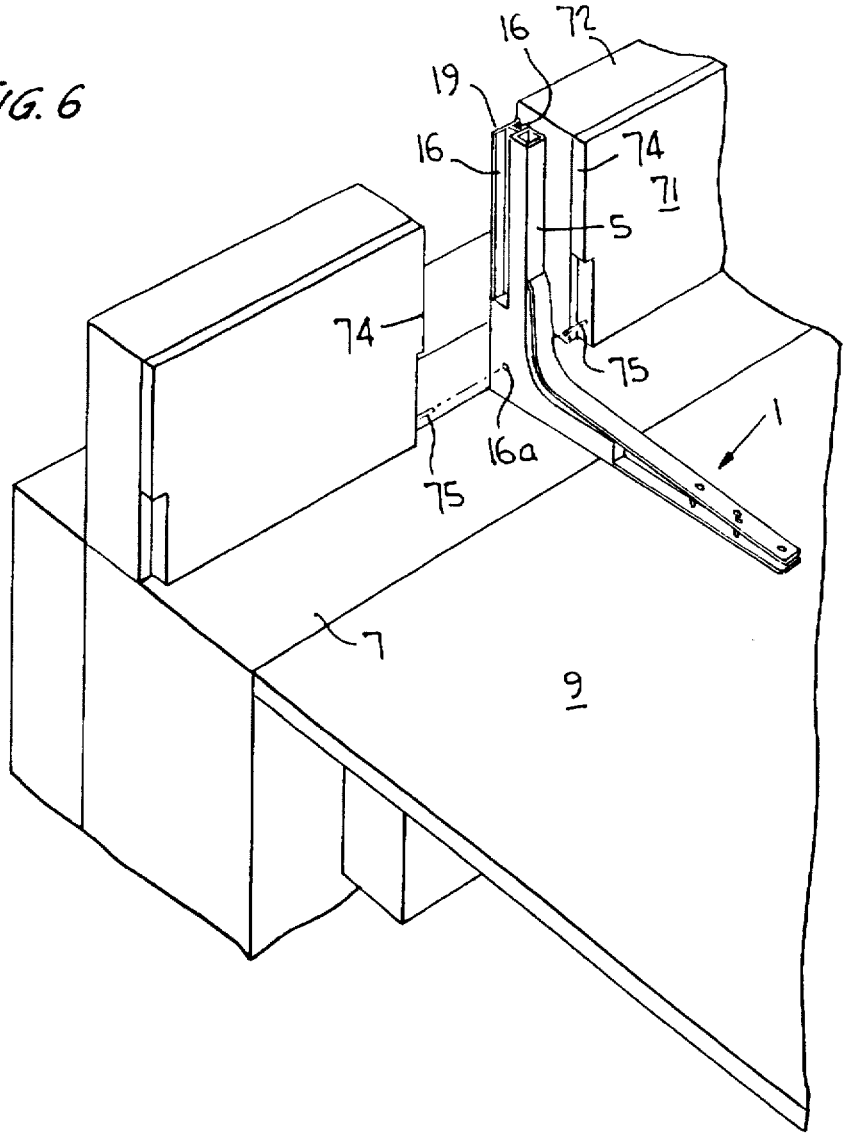
FIG. 6 illustrates schematically in perspective an insulation formwork arrangement which is mounted to an inventive plastic securing part.
Figure 7:
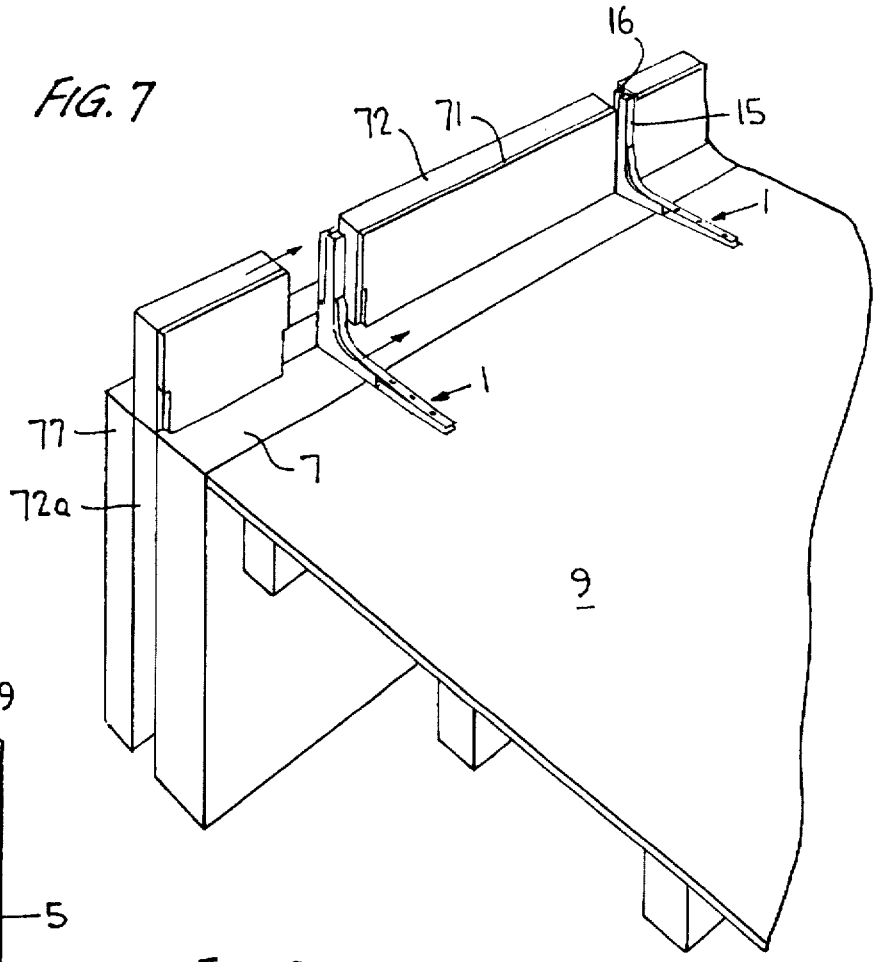
FIG. 7 illustrates outer insulation mounted firmly by means of plastic securing parts.

In FIGS. 6 and 7, the significance of the longitudinal groove or notching will now be entered into which already has been mentioned with reference to FIG. 1. It is namely illustrated in FIGS. 6 and 7 that at the inventively defined securing device 1, there also exists the possibility to mount insulation and supporting panels, respectively, which are to be placed at the outside of the building structure and which can simultaneously serve as formwork for the front terminal area of the floor slab to be encased.

In FIG. 6, again an inventive securing device lying on a floor slab formwork 9 and on the wall structure 7 is arranged, which such as mentioned comprises at both sides of the vertical leg grooves or longitudinally designed notchings foreseen for insertion or plugging-in, respectively, of the two projecting portions 74 of insulation reinforcement panels 71 which can be made for example of wood cement. The actual insulation layer 72, consisting for example of polystyrene or any other material suitable for insulating, is arranged, bonded or screwed thereonto. The mounting panels 71 can include, furthermore, for example pin-like elements 75 which can be inserted into corresponding receiving openings 16*a* in the securing device 1.

In FIG. 7, it is shown how such an insulation also serving as edge encasement formwork can be arranged by means of the inventively defined supporting parts 1, made of metal or plastic material. Again, two supporting elements are located on the floor slab formwork 9 and the balustrade of the wall 7, whereby the insulation consisting of the mounting plate 71 and the insulation layer 72 are already firmly mounted by one supporting element 1. At the other supporting part 1, the mounting proceeds in the direction of the arrow. Along the outer surface of the way the insulation finds the corresponding continuation by a placing of further insulation panels 72*a* which, for example, can be covered against the outside by a second wall structure 77. The outer covering can, however, be also made by a mat reinforced PVC or cement insulation.

The major advantage of the edge formwork according to FIGS. 6 and 7 is that after the concrete floor slab has been made, removal of the formwork is not necessary. Moreover, it is obviously also possible to place in the upper opening 19 of the supporting element 1 in FIGS. 6 and 7 a breastwork bar for erecting a safety breastwork along the building structure.

Figure 8:
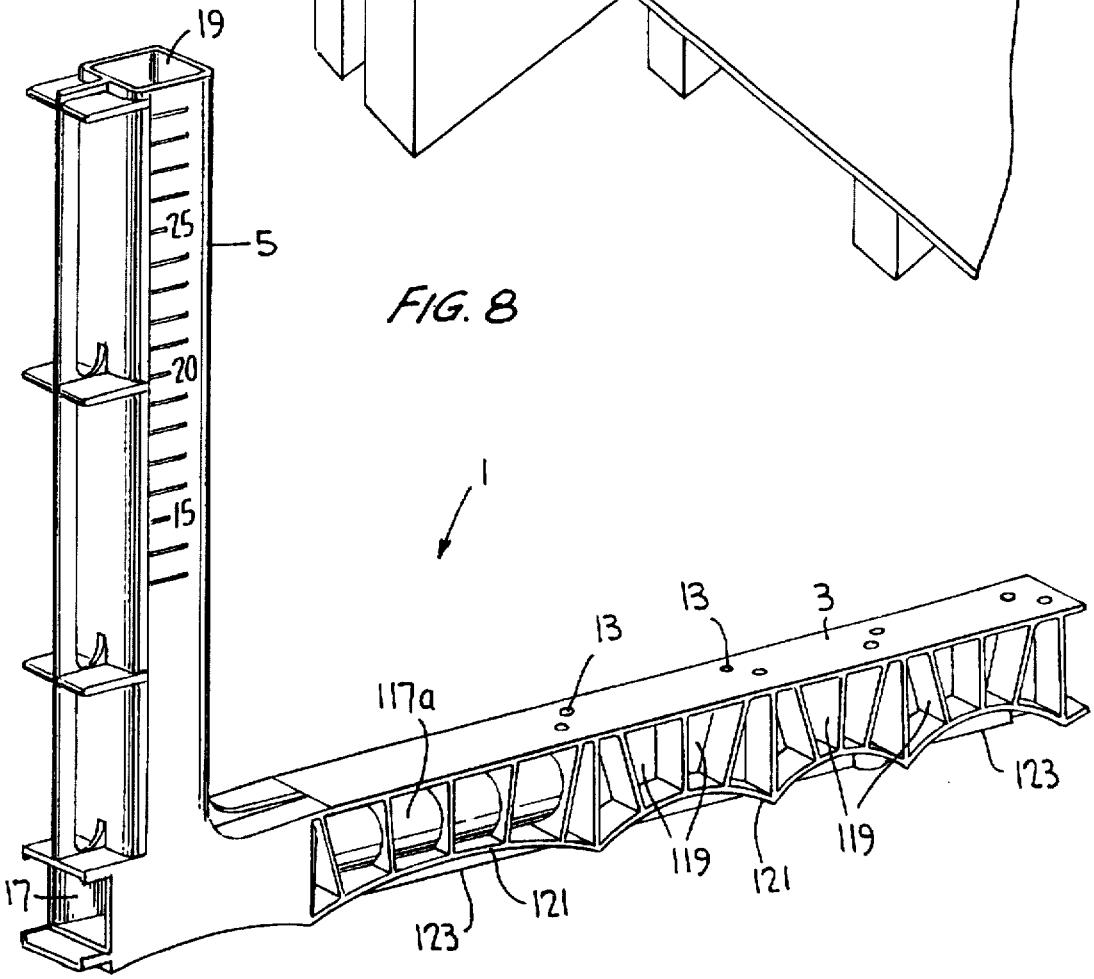
FIG. 8 illustrates the securing device of the present invention having an inner threaded portion, and outer recesses formed by supporting ribs.

In FIG. 8, supporting part 1 is shown with longer leg 3 having recesses or holes 119 defined by curved or bent longitudinal ribs 121. These longitudinal ribs 121 serve to strengthen longer leg 3. This is in particular beneficial before concrete surrounds the supporting part. The recesses 119 will be filled with concrete when the supporting part is embedded in concrete, such as in forming a concrete floor. Also shown in FIG. 8, as well as FIG. 9, is a longitudinally extending rib 123 which serves to further strengthen the longer leg 3 against bowing under a load.

Figure 9:
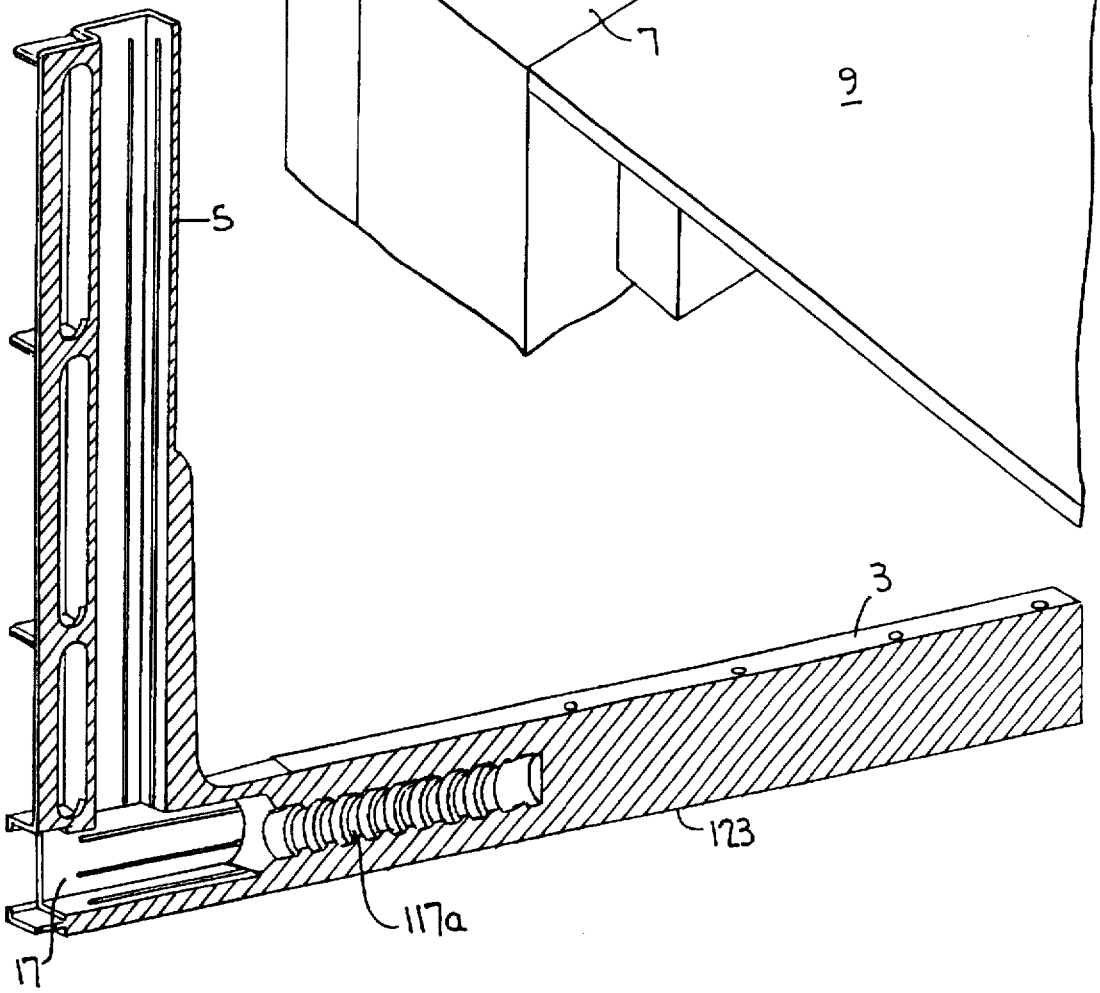
FIG. 9 illustrates in cross section the securing device shown in FIG. 8.

FIGS. 8 and 9 further show a preferred embodiment of holding fixture 17*a*. As described above, receiving portions in the supporting part can provide pluggable, snappable and/or screwable mounting. With respect to holding fixture 17*a*, a preferred embodiment includes contoured walls in the form of receiving threads 117*a* which are defined by opening 17 and the walls of the longer leg 3. After supporting part 1 has been mounted, receiving threads 117*a* can screwably receive any securing, supporting and/or clamping element adapted to cooperate with the threads. Further, holding fixture 17*a* may be configured as a shouldered snap well (not shown) or any other contour that would allow a snap-in or plug-in piece to be inserted into opening 17 and secured within holding fixture 17*a*. Again, opening 17 remains accessible after concrete has been poured about the supporting part 1. The threaded or otherwise contoured portion of the holding fixture is particularly advantageous in that it allows easy and simplified connection of scaffolding, formwork structures or other apparatus to the supporting part 1.

The securing devices illustrated in FIGS. 1 to 9, are examples of the invention which can be altered, modified or completed somehow or other by further parts. Preferably, the supporting part illustrated in the examples is made of a reinforced polymeric material. However, it is to be mentioned, specifically with reference to FIG. 5, that the inventively defined and claimed scaffolding breastwork and formwork structure is also by all means suitably arranged in a metal supporting part. The design of the individual scaffolding breastwork and formwork elements can also be modified.

I claim:

1. Device for releasably securing formwork encasings of lateral terminations of building parts comprising a substantially L-shaped anchorable support member, made of a polymeric material, having a first leg and a second leg, wherein said first leg and said second leg are structured to receive and hold in place at least one securing, supporting and/or clamping element constructed and arranged to hold floor slabs and/or formwork boards, and wherein said first leg includes a bearing surface having a width and length which stably supports said support member on a base supporting surface and further includes a plurality of ribs that strengthen said first leg and define a plurality of recesses, with each recess being defined by at least a top wall and a bottom wall of the first leg; and wherein, at a point said first leg joins said second leg, a first opening is integrally formed in said first leg and extends in the form of a cavity having contoured walls internally into said first leg, said contoured walls being constructed and arranged to detachably receive and secure a building construction element in such a manner that in use when the support member is embedded in concrete the opening remains freely accessible to allow insertion of the building construction element therein.

2. Device according to claim 1 wherein said contoured walls form receiving threads to screwably receive the building construction element.

3. Device according to claim 1 wherein said contoured walls form a shouldered snap well to receive the building construction element.

4. Device according to claim 1 wherein said polymeric material of said L-shaped anchorable support member is a reinforced polymeric material.

5. Device according to claim 1 wherein said bearing surface is substantially planar.

6. Device according to claim 1 wherein said polymeric material is a synthetic plastic material.

7. Device according to claim 6 wherein said synthetic plastic material is selected from a group consisting of polyethylene, polyvinyl chloride, polypropylene and acrylonitrile-butadiene-styrene.

8. Device according to claim 1 wherein said support member is made of a fiber reinforced polymeric concrete.

9. Device according to claim 4 wherein said reinforced polymeric material is a glass-filled polymeric material.

10. Device according to claim 8 wherein said fiber reinforced polymeric concrete is glass fiber reinforced polymeric concrete.

11. Device according to claim 1 wherein said support member includes in addition to said first opening at least one receiving portion for mounting said at least one securing, supporting and/or clamping element.

12. Device according to claim 1 further comprising a fastening means for securing said first leg to said base surface.

13. Device according to claim 1 wherein said support member further comprises at least one anchor element which is arranged on said support member such that in use said support member is embedded in concrete while simultaneously allowing said at least one anchor element to firmly anchor said support member in said concrete.

14. Device according to claim 13 wherein said anchor element is a projection integral with or attached to said support member.

15. Device according to claim 14 wherein said anchor element is at least one notch formed in said support member.

16. Device according to claim 1 wherein said second leg is a tube-shaped holding fixture with a second opening in an end not attached to said first leg, said second opening structured to receive a building construction element.

17. Device according to claim 1 wherein side walls of said second leg include at least one lateral receiving portion for receiving and securing to said second leg a building construction element.

18. Device according to claim 17 wherein each lateral receiving portion is a groove extending longitudinally in said second leg.

19. Device according to claim 17 wherein said at least one lateral receiving portion receives said building construction element and said building construction element is at least one insulation and/or wall panel having an end structured for mounting in said lateral receiving portion in said second leg of said support member.

20. Device according to claim 1 wherein said substantially L-shaped support member has a reinforcing member attached to portions of said first leg and said second leg which form an inside angle of said L-shaped support member.

21. Device according to claim 1 wherein said second leg receives and is present in combination with said at least one securing, supporting and/or clamping element, and said at least one securing, supporting and/or clamping element is at least a clamping element including a plug portion which is received in an opening in said second leg and a clamp portion attached to said plug portion wherein said clamp portion is constructed and arranged to clamp a formwork member against said second leg.

22. Device according to claim 1 wherein said second leg releasably receives and is present in combination with said at least one securing, supporting and/or clamping element and said at least one securing, supporting and/or clamping element is at least one member of the group consisting of a scaffolding support bracket, a clamping element, a breastwork bar, and a securing means for formwork.

23. Device of claim 1 wherein the plurality of ribs that define the plurality of recesses shape the recesses to accept concrete therein to support said first leg when the support member is embedded in concrete.

* * * * *